US006416345B1

(12) United States Patent
Endo

(10) Patent No.: US 6,416,345 B1
(45) Date of Patent: Jul. 9, 2002

(54) CONNECTOR LOCK MECHANISM WITH ELASTIC ARM PORTION

(75) Inventor: Tomomi Endo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/650,736

(22) Filed: Aug. 30, 2000

(30) Foreign Application Priority Data

Aug. 30, 1999 (JP) ..... 11-243596

(51) Int. Cl.[7] ..... H01R 13/627
(52) U.S. Cl. ..... 439/358; 439/352
(58) Field of Search ..... 439/352, 358, 439/353, 354, 355, 356

(56) References Cited

U.S. PATENT DOCUMENTS 5,830,000 A * 11/1998 Shifflett et al. ..... 439/352

FOREIGN PATENT DOCUMENTS

| | | | |
|---|---|---|---|
| DE | 19950954 A1 | 5/2000 | |
| JP | 60-77 | 1/1985 | ..... H01R/13/639 |
| JP | 2-57578 | 4/1990 | ..... H01R/13/639 |
| JP | 10-112356 | 4/1998 | |
| JP | 0 949 717 A2 | 10/1999 | ..... H01R/13/627 |
| JP | 11-297423 | 10/1999 | ..... H01R/13/639 |

* cited by examiner

*Primary Examiner*—Tho D. Ta
*Assistant Examiner*—Truc Nguyen
(74) *Attorney, Agent, or Firm*—Sughrue Mion, PLLC

(57) ABSTRACT

A lock arm (15) is formed on an outer surface of the male connector housing (12), and extends in a connector fitting direction, and the arm engagement portion (17) is formed on an outer surface of the female connector housing (13), and when the two connector housings are completely fitted together, the arm engagement portion (17) retains an engagement projection (15*b*) of the lock arm (15) to lock the two connector housings together in a connected condition. The arm engagement portion (17) has a push-out guide surface (17*a*) for producing a disengaging force, urging the two connector housings away from each other, in a half-fitted condition of the two connector housings, and a retaining portion (17*b*) for retaining the engagement projection (15*b*) in a completely-fitted condition of the two connector housings. The engagement of the engagement projection (15*b*) with the retaining portion (17*b*) can be canceled by elastically deforming the lock arm (15) in a direction generally parallel to the outer surface of the female connector housing (13).

4 Claims, 6 Drawing Sheets

CONNECTOR LOCK MECHANISM WITH ELASTIC ARM PORTION

BACKGROUND OF THE INVENTION

1. Field of the Invention

The present invention relates to a connector lock mechanism. More particularly, the present invention relates to a connector lock mechanism in which a half-fitted condition is positively prevented by a disengaging force (repelling force) produced between a pair of connector housings to be fittingly connected together so that the fitting connection to the mating connector can be positively locked.

The present application is based on Japanese Patent Application No. Hei. 11-243596, which is incorporated herein by reference.

2. Description of the Related Art

Usually, various electronic equipments are mounted on a vehicle such as an automobile, and therefore, naturally, various types of male and female connectors are provided at connection ends of various wires forming wire harnesses or the like.

Generally, male and female connectors to be fittingly connected together are provided with a lock mechanism, in which when the amount of fitting of the two connectors relative to each reaches a predetermined value, their respective connector housings are locked together in a fittingly-connected condition.

When the connector housings of the male and female connectors are connected together by the lock mechanism, each of connection terminals in the male connector housing is electrically connected to a respective one of connection terminals in the female connector housing with adequate contact pressure and contact area.

However, for example, when the operating force for fitting the two connector housings together is inadequate, and when either of the connector housings or any of the connection terminals is defective, the connector fitting operation is sometimes finished in a half-fitted condition in which the amount of fitting of the two connector housings relative to each other fails to reach the predetermined value.

When the male and female connectors are used in such a half-fitted condition, they may be disengaged from each other because of vibrations, developing during use, and the tension of a wire harness, and this can leads to a disadvantage that the feeding of electric power is interrupted. Even if the two connectors are not disengaged from each other, there is a possibility that in the half-fitted condition, the mating connection terminals are incompletely electrically connected together, in which case the necessary electrical characteristics are not obtained, and this may lead to a disadvantage that the associated electric part is subjected to a malfunction.

Therefore, in order to prevent an accident due to a failure to notice such a half-fitted condition of the two connectors, there has been proposed a lock mechanism (which locks two connector housings in a mutually-connected condition) having a half-fitting prevention function for disengaging the two connector housings from each other when a half-fitted condition is encountered.

FIG. 8 shows a related connector lock mechanism having a half-fitting prevention function.

In this connector lock mechanism, a lock arm 5 is formed on an outer surface of a male connector housing 2 (one of male and female connector housings 2 and 3 to be fitted together in a male-female manner), and extends in a connector housing-fitting direction, whereas arm engagement portions 7 are formed on the female connector housing (the other connector housing) 3, and these arm engagement portions 7 retain engagement projections 5*b* of the lock arm 5, respectively, to lock the two connector housings together in a connected condition when the amount of fitting of the two connector housings relative to each other reaches a predetermined amount.

Female connection terminals are received respectively in terminal receiving chambers 2*a* formed in the male connector housing 2, and male connection terminals 9 are received respectively in terminal receiving chambers formed in the female connector housing 3.

The lock arm 5 has a pair of elastic arms 5*a* extending from a proximal end portion of the housing toward a distal end thereof, and the engagement projection 5*b* is formed on and projects laterally from an outer side surface of each of the elastic arms 5*a* at a distal end thereof.

The arm engagement portions 7 are formed in a projected manner respectively on inner surfaces of opposite side walls 3*b* and 3*b* of a front housing portion 3*a*, defining a space into which the male connector housing 2 can be fitted. Each of the arm engagement portions 7 has a slanting surface 7*a* and a retaining surface 7*b*. When the amount of fitting of the two connector housings relative to each other is less than the predetermined value, each slanting surface 7*a* presses the corresponding engagement projection 5*b* toward a vertical median plane of the housing to elastically deform the elastic arm 5*a* toward the vertical median plane of the housing, thereby producing a disengaging force urging the two connectors away from each other. When the amount of fitting of the two connector housings reaches the predetermined value, so that the elastic deformation of each elastic arm 5*a* by the corresponding slanting surface 7*a* is canceled, each retaining surface 7*b* retains the corresponding engagement projection 5*b*.

Namely, in the above connector lock mechanism, when the male and female connector housings 2 and 3 are fitted together, the elastic arms 5*a* are elastically deformed respectively by the slanting surfaces 7*a* through the engagement projections 5*b*, and as a result the disengaging force, tending to move the two connector housings 2 and 3 away from each other, is produced between each slanting surface 7*a* and the corresponding engagement projection 5*b* by the resilient force of the thus elastically-deformed elastic arm 5*a*. In this construction, any spring member (e.g. a compression coil spring), separate from the connector housings, is not used for producing the disengaging force to disengage the two connectors from each other, and therefore the half-fitting prevention function is achieved at a low cost without increasing the number of the component parts.

In the above lock mechanism, however, the arm engagement portions 7 are formed on the inner surface of the connector housing 3, and therefore the condition of engagement of the lock arm 5 with the arm engagement portions 7 can not be confirmed with the eyes, and thus there has been a disadvantage that the fitting connection can not be confirmed with the eyes.

And besides, for canceling the locked condition, the proximal end portion of the lock arm 5 is pressed so as to turn its distal end portion downwardly, and therefore a large operating force is required when canceling the locked condition, and this has invited a problem that the cancellation of the locked condition is difficult.

SUMMARY OF THE INVENTION

It is therefore an object of the present invention to overcome the above problems, and more specifically to provide a connector lock mechanism in which a half-fitted condition is positively prevented, and a condition of engagement of a lock arm with an arm engagement portion can be confirmed with the eyes, and besides an operating force, required for canceling a locked condition of the two connector housings, can be reduced.

To achieve the above object, according to the present invention, there is provided a connector lock mechanism which comprises an elastically-deformable lock arm formed on an outer surface of one of male and female connector housings which are fittable to each other, the lock arm extending in a connector fitting direction, at least one engagement projection formed on the lock arm, at least one arm engagement portion formed on an outer surface of the other one of male and female connector housings, wherein when the male and female connector housings are completely fitted to each other, the arm engagement portion retains the engagement projection of the lock arm to lock the male and female connector housings, at least one push-out guide surface formed on the arm engagement portion, wherein when the male and female connector housings are in a half-fitted condition, the push-out guide surface deforms the lock arm elastically in a direction away from the outer surface of the one of male and female connector housings, thereby producing a disengaging force urging the male and female connector housings away from each other, and at least one retaining portion formed on the arm engagement portion, wherein when the male and female connector housings are completely fitted to each other so that elastic deformation of the lock arm by the push-out guide surface is canceled, the retaining portion retains the engagement projection, wherein engagement of the engagement projection with the retaining portion is canceled by elastic deformation of the lock arm in a direction substantially parallel to the outer surface of the other one of male and female connector housing.

In the above construction, the lock arm and the arm engagement portion are formed on the outer surfaces of the connector housings, respectively, and those portions of the lock arm and the arm engagement portion, engaged with each other, are exposed to the outsides of the two connector housings.

Therefore, the condition of engagement of the lock arm with the arm engagement portion can be easily confirmed with the eyes. When canceling the locked condition of the two connector housings, the lock arm can be elastically deformed by operating or manipulating the pivotally-movable distal end portion of this lock arm, and therefore the operating force, required for canceling the locked condition, can be reduced.

The lock arm is elastically deformed in the direction away from the outer surface of the connector housing so as to produce the disengaging force during the connector fitting operation. On the other hand, when canceling the locked condition of the two connector housings, the lock arm is elastically deformed in the direction generally parallel to the outer surface of the connector housing.

Therefore, a clearance between the outer surface of the connector housing and the lock arm can be minimized, and therefore the vertical dimension of the pair of connectors can be reduced.

For example, the cross-sectional shape or other of the lock arm is determined such that the lock arm has a high elastic coefficient (elasticity modulus) in the direction away from the outer surface of the connector housing, but has a low elastic coefficient in the direction generally parallel to the outer surface of the connector housing. With this arrangement, the disengaging force for preventing a half-fitted condition can be set to a sufficiently-large value while the operating force for canceling the locked condition can be kept to a small level.

In the above connector lock mechanism, it is preferable that the engagement projection is formed on a lateral side surface of the lock arm. In the above connector lock mechanism, it is preferable that the push-out guide surface has a smoothly slanting portion.

DETAILED DESCRIPTION OF THE PREFERRED EMBODIMENTS

One preferred embodiment of a connector lock mechanism of the present invention will now be describe in detail with reference to the drawings.

Figure 1:
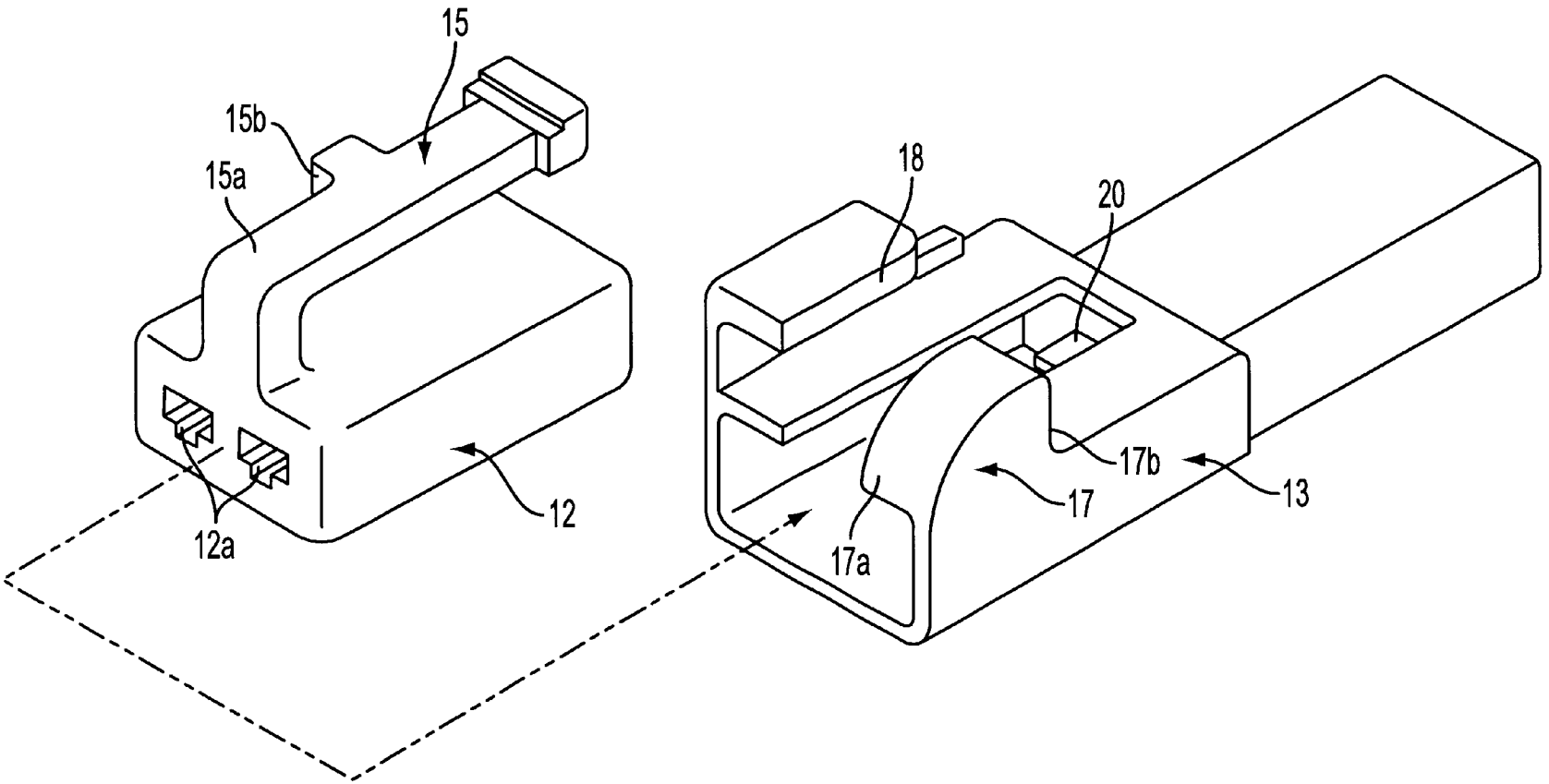
FIG. 1 is an exploded, perspective view of male and female connector housings provided with a first embodiment of a connector lock mechanism of the present invention.
Figure 2:
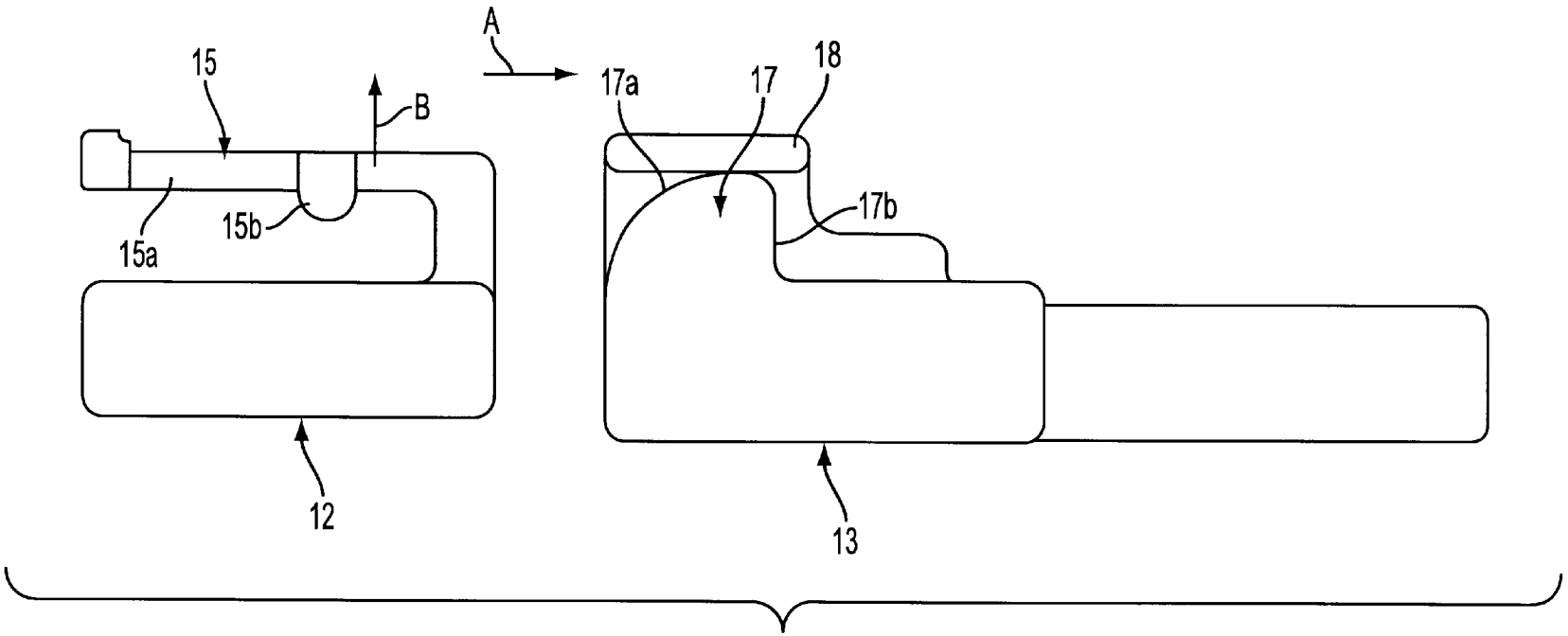
FIG. 2 is a front-elevational view of the male and female connector housings of FIG. 1.

As shown in FIGS. 1 and 2, in the first embodiment of the connector lock mechanism of the present invention, a lock arm 15 is formed on an outer surface of a male connector housing 12 (one of male and female connector housings 12 and 13 to be fitted together in a male-female manner), and an arm engagement portion 17 is formed on an outer surface of the female connector housing (the other connector housing) 13, and when the two connector housings are completely fitted together, the arm engagement portion 17 retains an engagement projection 15*b* of the lock arm 15 to lock the two connector housings together in a connected condition.

Female connection terminals (not shown) are received respectively in terminal receiving chambers 12*a* formed in the male connector housing 12, and male connection terminals 20 are received respectively in terminal receiving chambers formed in the female connector housing 13.

The lock arm 15 includes an elastic arm 15*a* extending in a connector housing-fitting direction (indicated by arrow A in FIG. 2), and the engagement projection 15*b* is formed on this elastic arm 15*a*. In this embodiment, the elastic arm 15*a* extends upwardly from a distal end portion of the male connector housing 12, and further extends toward a proximal end thereof. In this embodiment, the engagement projection 15*b* projects from one side edge of the elastic arm 15*a* toward the outer surface of the housing.

The arm engagement portion 17 has a push-out guide surface 17*a*, and a retaining portion 17*b*. When the two connector housings are in a half-fitted condition, the push-out guide surface 17*a* abuts against the engagement projection 15*b* to elastically deform the lock arm 15 in a direction (indicated by arrow B in FIG. 2) away from the outer surface of the male connector housing 12, thereby producing a disengaging force urging the two connectors away from each other. When the two connector housings are completely fitted together, so that the elastic deformation of the lock arm 15 by the push-out guide surface 17*a* is canceled, the retaining portion 17*b* retains the engagement projection 15*b*. The arm engagement portion 17 is provided in an offset manner so as to be opposed to the engagement projection 15*b* formed on and projecting from the one side edge of the elastic arm 15*a*.

The push-out guide surface 17*a* is defined by a smoothly-curved surface slanting upwardly from the distal end of the female connector housing 13 toward the proximal end thereof. The retaining portion 17*b* is defined by a vertical surface provided at a rear end of the push-out guide surface 17*a*.

In this embodiment, the engagement of the engagement projection 15*b* with the retaining portion 17*b* can be canceled by elastically deforming the elastic arm 15*a* away from the arm engagement portion 17 in a direction generally parallel to the outer surface (upper surface) of the female connector housing 13.

In this embodiment, an arm deformation prevention portion 18 is provided on that side of the female connector housing 13 opposite to the arm engagement portion 17. At the time of fitting the two connector housings together, this arm deformation prevention portion 18 abuts against the other side edge of the elastic arm 15*a* to prevent this elastic arm 15*a* from being accidentally elastically deformed in a direction away from the arm engagement portion 17.

Next, the operation for fittingly connecting the male and female connector housings 12 and 13 together will be described with reference to FIGS. 3A to 3D.

Figure 3A:
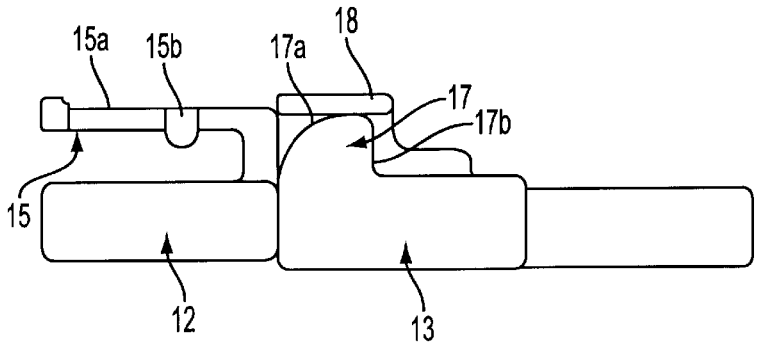
FIGS. 3A to 3D are a front-elevational view of the male and female connector housings, showing an operation for fitting the two connector housings together, FIG. 3A showing a condition immediately before the male and female connector housings begin to be fitted together, FIG. 3B showing an initial stage of the fitting connection between the male and female connector housings, FIG. 3C showing a half-fitted condition of the male and female connector housings, and FIG. 3D showing a completely-fitted condition of the male and female connector housings.
Figure 3B:
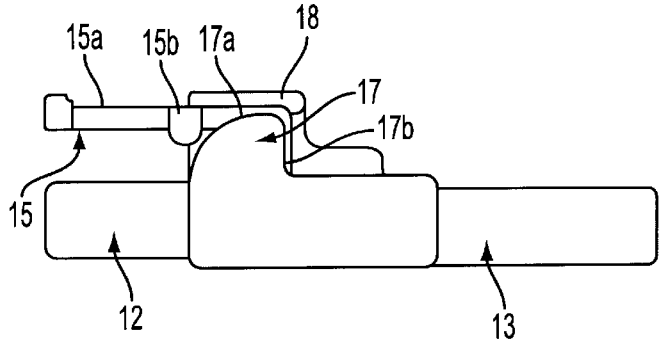
Figure 3C:
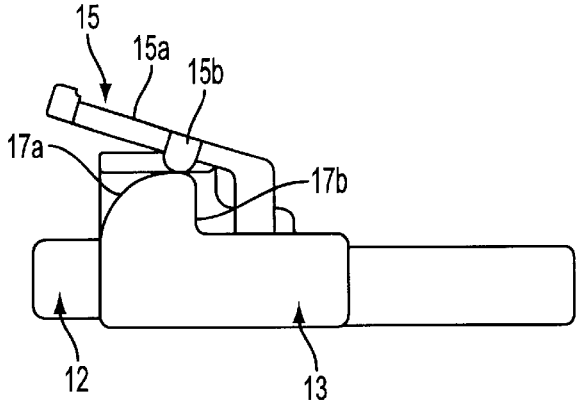

First, as the front end portion of the male connector housing 12 is pushed or inserted into a front opening in the female connector housing 13 as shown in FIGS. 3A and 3B, the engagement projection 15*b* of the lock arm 15 slides over the push-out guide surface 17*a* of the arm engagement portion 17, so that the elastic arm 15*a* is elastically deformed away from the outer surface of the female connector housing 13, as shown in FIG. 3C.

Therefore, a disengaging force, urging the two connector housings 12 and 13 away from each other, is produced between the half-fitted connector housings 12 and 13 by the resilient force of the thus-elastically deformed elastic arm 15*a*.

Therefore, when this pushing operation is stopped in this half-fitted condition, the two connector housings 12 and 13 are pushed back away from each other in their respective disengaging directions (opposite to their fitting directions), so that this half-fitted condition can be easily detected.

Then, when this connector fitting operation further proceeds, the male and female connector housings 12 and 13 are completely fitted together. More specifically, the engagement projection 15*b* slides past the push-out guide surface 17*a*, so that the elastic deformation of the elastic arm 15*a* is canceled as shown in FIG. 3D, and as a result of cancellation of elastic deformation of this elastic arm 15*a*, the engagement projection 15*b* is returned to its proper position, and is retained by the retaining portion 17*b* of the arm engagement portion 17, so that the male and female connector housings 12 and 13 are locked together in a fittingly-connected condition.

Figure 3D:
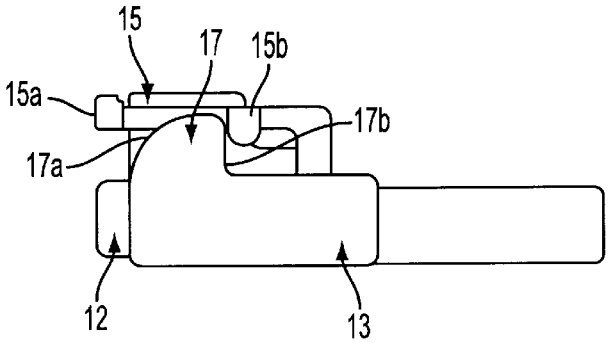
Figure 4:
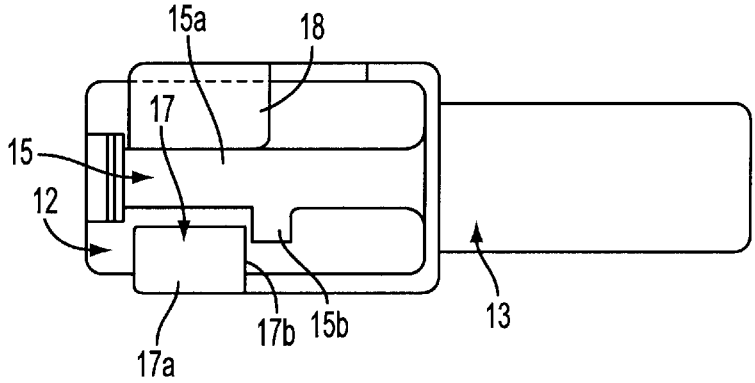
FIG. 4 is a plan view of the male and female connector housings of FIG. 3D.

When the male and female connector housings 12 and 13 are locked together in a fittingly-connected condition as shown in FIG. 3D, the elastic arm 15*a* is held between the arm deformation prevention portion 18 and the arm engagement portion 17 as shown in FIG. 4, and in so far as this condition is maintained, the elastic arm 15*a* can not be elastically deformed even in the direction away from the arm engagement portion 17 in generally parallel relation to the outer surface (upper surface) of the female connector housing 13.

Namely, even when an external force acts on the elastic arm 15*a* in a direction generally parallel to the outer surface of the housing, the elastic displacement of the elastic arm 15*a* in the direction generally parallel to the outer surface of the housing is prevented by the arm engagement portion 17 and the arm deformation prevention portion 18, and therefore the locked condition will not be accidentally canceled.

Figure 5:
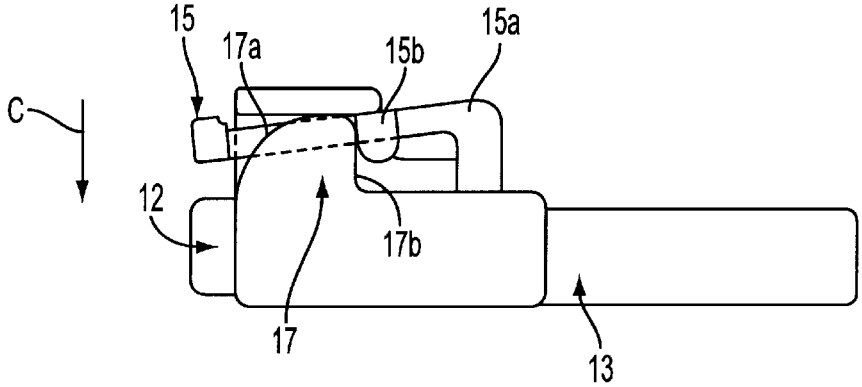
FIG. 5 is a front-elevational view of the male and female connector housings, showing a condition in which a lock arm is depressed so as to cancel a locked condition.
Figure 6:
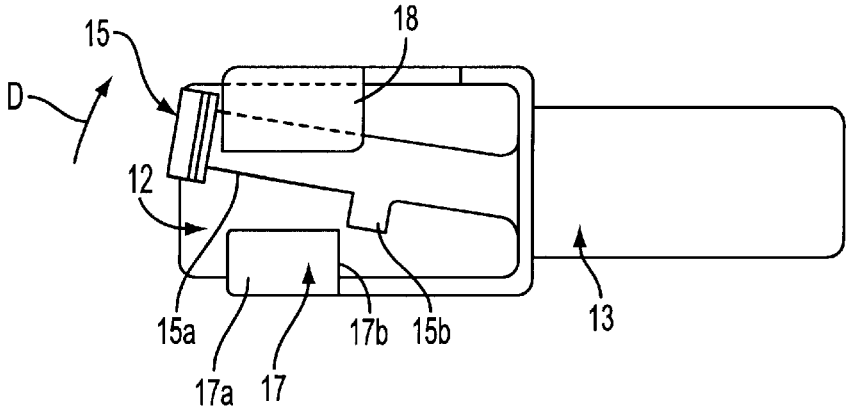
FIG. 6 is a plan view of the male and female connector housings, showing a condition in which the lock arm is elastically deformed in a direction generally parallel to the outer surface of the connector housing so as to cancel the locked condition.

For canceling the locked condition of the male and female connector housings 12 and 13, the elastic arm 15*a* is pressed in a direction of arrow C to be elastically deformed into such a height or level as not to interfere with the arm deformation prevention portion 18, as shown in FIG. 5, and in this condition, the elastic arm 15*a* is further elastically deformed in the direction (indicated by arrow D) away from the arm engagement portion 17 in generally parallel relation to the outer surface of the housing, as shown in FIG. 6. As a result, the engagement of the engagement projection 15*b* with the retaining portion 17*b* is canceled, and therefore the two connectors can be disengaged from each other by pulling the male and female connector housings 12 and 13 away from each other.

As described above, in the connector lock mechanism of this embodiment, when fitting the male and female connector housings 12 and 13 together, the elastic arm 15*a* is elastically deformed by the push-out guide surface 17*a*, and the disengaging force, urging the two connector housings away from each other, is produced between the push-out guide surface 17*a* and the lock arm 15 by the resilient force of the elastically-deformed elastic arm 15*a*. Any spring member or the like, separate from the connector housings, is not used for producing the disengaging force to disengage the two connectors from each other, and therefore the connector half-fitting prevention is achieved at a low cost without increasing the number of the component parts.

The lock arm 15 and the arm engagement portion 17 are formed on the outer surfaces of the connector housings, respectively, and those portions of the lock arm 15 and the arm engagement portion 17, engaged with each other, are exposed to the outsides of the male and female connector housings 12 and 13.

Therefore, the condition of engagement of the lock arm 15 with the arm engagement portion 17 can be easily confirmed with the eyes. When canceling the locked condition of the male and female connector housings 12 and 13, the lock arm 15 can be elastically deformed by operating or manipulating the pivotally-movable distal end portion of this lock arm, and therefore the operating force, required for canceling the locked condition, can be reduced.

The lock arm 15 is elastically deformed in the direction away from the outer surface of the female connector housing 13 so as to produce the disengaging force during the connector fitting operation as shown in FIG. 3C. On the other hand, when canceling the locked condition of the male and female connector housings 12 and 13, the lock arm 15 is elastically deformed in the direction generally parallel to the outer surface of the female connector housing 13.

Therefore, a clearance between the outer surface of the female connector housing 13 and the lock arm 15 can be minimized, and therefore the vertical dimension of the male and female connectors can be reduced.

Namely, when canceling the locked condition of the male and female connector housings 12 and 13, the lock arm 15 need only to be elastically deformed toward the outer surface of the female connector housing 13, that is, into such a level as not to interfere with the arm deformation prevention portion 18, and unlike the lock arm of the related art, this lock arm 15 does not need to be much elastically deformed toward the outer surface of the female connector housing 13 so as to be disengaged from the engagement portion.

For example, the cross-sectional shape or other of the elastic arm 15*a* is determined such that the elastic arm 15*a* has a high elastic coefficient (elasticity modulus) in the direction away from the outer surface of the female connector housing 13, but has a low elastic coefficient in the direction generally parallel to the outer surface of the female connector housing 13. With this arrangement, the disengaging force for preventing the half-fitted condition can be set to a sufficiently-large value while the operating force for canceling the locked condition can be kept to a small level.

The connector lock mechanism of the present invention is not limited to the first embodiment, but can be suitably modified within the scope of the present invention.

Figure 7:
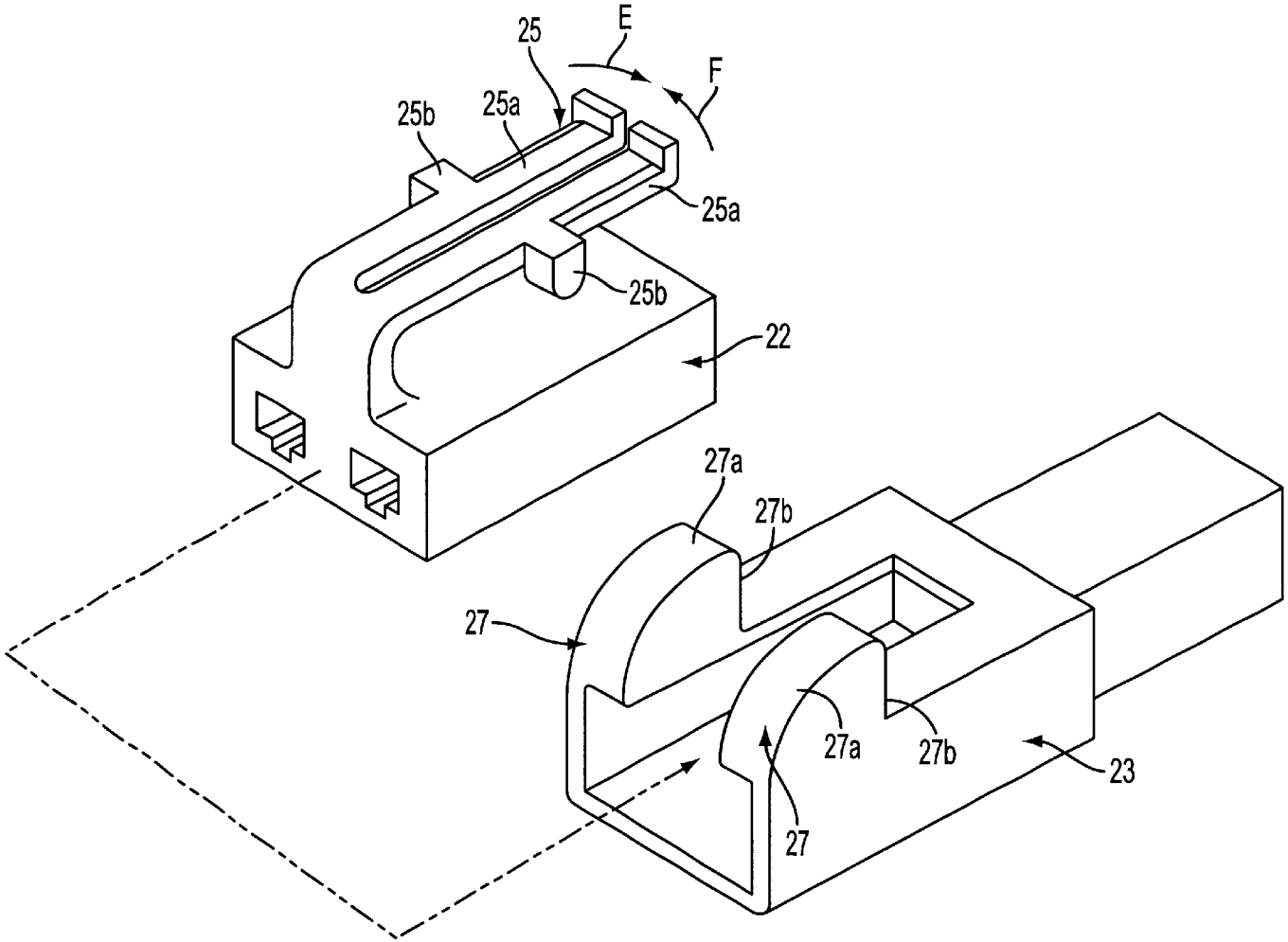
FIG. 7 is an exploded, perspective view of male and female connector housings provided with a second embodiment of a connector lock mechanism of the present invention.
Figure 8:
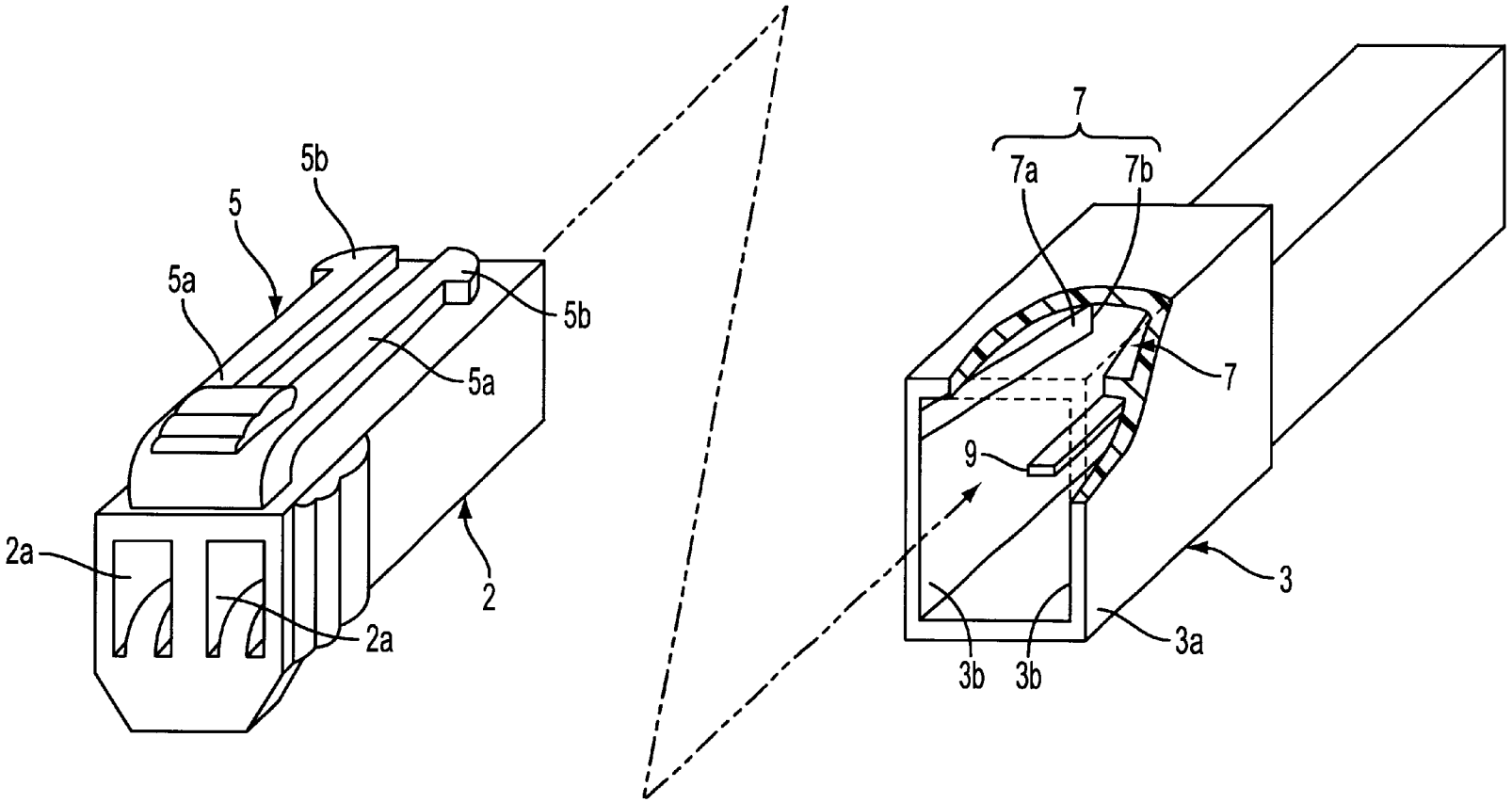
FIG. 8 is an exploded, perspective view of male and female connector housings provided with a related connector lock mechanism.

For example, a pair of male and female connectors, provided with a second embodiment of a connector lock mechanism of the present invention, are shown in FIG. 7. A lock arm 25, formed on an outer surface of a male connector housing (one connector housing) 22 includes a pair of parallel elastic arms 25*a* and 25*a* spaced a predetermined distance from each other, and a pair of engagement projections 25*b* and 25*b* formed on and projecting from outer side edges of the two elastic arms 25*a* and 25*a*, respectively. A pair of arm engagement portions 27 and 27, corresponding respectively to the pair of elastic arms, are formed on an outer surface of a female connector housing (the other connector housing) 23.

As a front end portion of the male connector housing 22 is pushed or inserted into a front opening in the female connector housing 23, the engagement projections 25*b* of the lock arm 15 slide over push-out guide surfaces 27*a* of the arm engagement portions 27, so that the elastic arms 25*a* are elastically deformed away from the outer surface of the female connector housing 23.

Therefore, a disengaging force, urging the two connector housings 22 and 23 away from each other, is produced between the half-fitted connector housings 22 and 23 by the resilient force of the thus-elastically deformed elastic arms 25*a*, as described above for the male and female connector housings 12 and 13 of the first embodiment, and therefore similar effects can be obtained.

In the connector lock mechanism of this second embodiment, however, when canceling the locked condition of the male and female connector housings 22 and 23, the pair of elastic arms 25*a* and 25*a* are elastically deformed toward each other (as indicated by arrows E and F in FIG. 7) by the fingers, so that the pair of engagement projections 25*b* and 25 are disengaged from retaining portions 27*b* of the two arm engagement portions 27.

In the above embodiments, although the pushout guide surface 17*a* (27*a*) for elastically deforming the elastic arm 15*a* (25*a*) during the fitting connection between the male and female connector housings is the curved surface, this push-out guide surface can be formed into a slanting (tapering) surface inclined at a suitable angle, and also can be formed into any other suitable shape so that the optimum disengaging force can be obtained in accordance with a change in the force of fitting between the male and female connection terminals mounted in the connector housings.

In the lock mechanism of the present invention, the lock arm and the arm engagement portion are formed on the outer surfaces of the connector housings, respectively, and those portions of the lock arm and the arm engagement portion, engaged with each other, are exposed to the outsides of the two connector housings.

Therefore, the condition of engagement of the lock arm with the arm engagement portion can be easily confirmed with the eyes. When canceling the locked condition of the two connector housings, the lock arm can be elastically deformed by operating or manipulating the pivotally-movable distal end portion of this lock arm, and therefore the operating force, required for canceling the locked condition, can be reduced.

The lock arm is elastically deformed in the direction away from the outer surface of the connector housing so as to produce the disengaging force during the connector fitting operation. On the other hand, when canceling the locked condition of the two connector housings, the lock arm is elastically deformed in the direction generally parallel to the outer surface of the connector housing.

Therefore, a clearance between the outer surface of the connector housing and the lock arm can be minimized, and therefore the vertical dimension of the pair of connectors can be reduced.

For example, the cross-sectional shape or other of the lock arm is determined such that the lock arm has a high elastic coefficient (elasticity modulus) in the direction away from the outer surface of the connector housing, but has a low elastic coefficient in the direction generally parallel to the outer surface of the connector housing. With this arrangement, the disengaging force for preventing a half-fitted condition can be set to a sufficiently-large value while the operating force for canceling the locked condition can be kept to a small level.

Therefore, there can be provided the connector lock mechanism in which a half-fitted condition is positively prevented, and the condition of engagement of the lock arm with the arm engagement portion can be confirmed with the eyes, and besides the operating force, required for canceling the locked condition of the two connector housings, can be reduced.

What is claimed is:

1. A connector lock mechanism comprising:

an elastically-deformable lock arm formed on an outer surface of one of male and female connector housings which are fittable to each other, the lock arm extending in a connector fitting direction;

at least one engagement projection formed on the lock arm;

at least one arm engagement portion formed on an outer surface of the other one of male and female connector housings, wherein when the male and female connector housings are completely fitted to each other, the arm engagement portion retains the engagement projection of the lock arm to lock the male and female connector housings;

at least one push-out guide surface formed on the arm engagement portion, wherein when the male and female connectors housings are in a half-fitted condition, the push-out guide surface deforms the lock arm elastically in a direction away from an outer surface of the one of male and female connector housings away from each other; and at least one retaining portion formed on the arm engagement portion, wherein when the male and female connector housings are completely fitted to each other so that elastic deformation of the lock arm by the push-out guide surface is canceled, the retaining portion retains the engagement projection, wherein engagement of the engagement projection with the retaining portion is canceled by elastic deformation of the lock arm in a direction substantially parallel to the outer surface of the other one of male and female connector housing;

wherein cancellation of the engagement of the engagement projection with the retaining portion further comprises elastic deformation of the lock arm in a direction toward the outer surface of one of the male and female connector housing.

2. The connector lock mechanism of claim 1, wherein the engagement projection is formed on a lateral side surface of the lock arm.

3. The connector lock mechanism of claim 1, wherein the push-out guide surface has a smoothly slanting portion.

4. The connector lock mechanism of claim 1, wherein the elastic coefficient of the lock arm is greater in the direction away from the outer surface of one of the male and female connector housing than in a direction substantially parallel to the outer surface of one of the male and female connector housing.

* * * * *